United States Patent [19]

Kirchhoff et al.

[11] 4,218,225

[45] Aug. 19, 1980

[54] ELECTROSTATIC PRECIPITATORS

[75] Inventors: Franz J. Kirchhoff, Olpe; Joachim Brandt, Wenden, both of Fed. Rep. of Germany

[73] Assignee: Apparatebau Rothemuhle Brandt & Kritzler, Fed. Rep. of Germany

[21] Appl. No.: 792,515

[22] Filed: May 2, 1977

Related U.S. Application Data

[63] Continuation-in-part of Ser. No. 758,702, Jan. 12, 1977, abandoned, which is a continuation of Ser. No. 579,081, May 19, 1975, abandoned.

[30] Foreign Application Priority Data

May 20, 1974 [DE] Fed. Rep. of Germany ..... 2424432

[51] Int. Cl.[2] ..... B03C 3/47; B03C 3/68; B03C 3/76

[52] U.S. Cl. ..... 55/112; 55/105; 55/133; 55/136; 55/139; 55/140; 55/419; 55/DIG. 38

[58] Field of Search ..... 55/105, 112, 130, 133, 55/136, 139, 140, 156, 289, 344, 419, DIG. 38, 272, 110

[56] References Cited

U.S. PATENT DOCUMENTS

| | | | |
|---|---|---|---|
| 1,800,529 | 4/1931 | Horne | 55/112 |
| 2,042,181 | 5/1936 | Knowles | 55/105 |
| 2,050,367 | 8/1936 | Myhre | 55/105 |
| 2,271,597 | 2/1942 | Lodge | 55/130 |
| 2,501,513 | 3/1950 | Hedberg | 55/136 |
| 2,588,364 | 3/1952 | Digiorgi | 55/112 |
| 3,089,082 | 5/1963 | Little | 55/105 |
| 3,166,705 | 1/1965 | Brandt | 55/105 |
| 3,200,565 | 8/1965 | Gustafsson | 55/112 |
| 3,201,923 | 8/1965 | Gustafsson et al. | 55/112 |
| 3,504,480 | 4/1970 | Copcutt et al. | 55/112 |

FOREIGN PATENT DOCUMENTS

| | | | |
|---|---|---|---|
| 247085 | 2/1963 | Australia | 55/112 |
| 364808 | 8/1919 | Fed. Rep. of Germany | 55/112 |
| 536809 | 10/1931 | Fed. Rep. of Germany | 55/112 |
| 764702 | 8/1951 | Fed. Rep. of Germany | 55/130 |
| 2424432 | 12/1975 | Fed. Rep. of Germany | 55/136 |
| 40-22800 | 9/1965 | Japan | 55/112 |
| 46-24358 | 7/1971 | Japan | 55/136 |
| 738241 | 10/1955 | United Kingdom | 55/140 |
| 981147 | 1/1965 | United Kingdom | 55/105 |
| 994562 | 6/1965 | United Kingdom | 55/136 |

*Primary Examiner*—David L. Lacey

*Attorney, Agent, or Firm*—Lockwood, Dewey, Alex & Cummings

[57] ABSTRACT

The overall effective volume of a horizontal gas flow electrostatic precipitator is divided into at least four electrostatic field units arranged in stages, there being at least upper and lower vertically aligned stages, the precipitator having a dust exit bunker which receives dust collected in each of the upper and lower stages. Below the collector electrodes of the upper stage are collection pockets which communicate with the dust exit bunker through downwardly extending dust passages located in the lower stage. These passages are internal passages within hollow collector electrodes of the lower stage. The electrostatic field units are, independently of one another, each connected to a respective separate controllable power supply means so that it is possible to generate, in each respective stage, a separate controllable high voltage. The power supply means in each stage are regulated so as to provide the required electrical characteristics, it being particularly preferred that the power supply means in each stage be self-regulating so as to automatically adjust the voltage in that stage to the desired value. Each stage is also provided with a separate rapper mechanism. Gas flow is preferably in opposite horizontal directions in vertically adjacent stages.

3 Claims, 2 Drawing Figures

ELECTROSTATIC PRECIPITATORS

CROSS REFERENCE

This application is a continuation-in-part of application No. 758,702; Jan. 12, 1977, now abandoned, which was a continuation of application No. 579,081; May 19, 1975; now abandoned.

FIELD OF THE INVENTION

The invention refers to electrostatic precipitators with horizontal throughflow of the gas. Such precipitators are used especially for cleaning of flue gases from steam boiler furnaces.

BACKGROUND OF THE INVENTION

Increases in the size of boilers has led to a tendency for the electrostatic precipitators used for the purification of their exhaust gases to determine the maximum width of the installation. Increased throughput cannot be dealt with by increasing only the height of the precipitators because elongation of the collector electrodes beyond a length of about 15 meters is connected with disadvantages on electrical grounds, on grounds of flow technique, and of difficulties of erection. Apart from the disadvantages of requirement for width there arise in the case of wide filter installation problems of distribution of gas flow and of high capital cost.

A multistage construction, with the gas flowing through horizontally, serves, in principle, the purpose of diminishing the floor space requirement of the installation and of enabling more uniform distribution of the gas over the whole cross-section of the flow.

However, in known proposals for such multistage electrostatic precipitators [e.g. in accordance with DTOS (German Laid Open Specification) 1 457 177], precipitator bays in the upper tiers of the electrostatic precipitator installation are equipped with their own dust bunkers which take up a considerable part of the overall height of the structure.

In U.S. Pat. No. 2,588,364 (De Giorgi) there was a solution of the problem of vertical compactness when one tier of electrodes was arranged one above the other, by using ducts arranged between electrodes of the lower tier as means for conducting dust precipitated from the upper tier to a hopper at the base of the construction. However, De Giorgi saw this as a single electrostatic precipitator arrangement, i.e. a multi-field single precipitator. He failed to consider the electrodes of different tiers as if they were separate precipitators and thereby failed to achieve even the basis of the present invention. In column 9, second paragraph of this U.S. patent specification it is stated that the discharge electrodes are all connected with a common rectifier. This patent specification thus does not disclose high voltage supplies, which can be regulated separately, for separate stages which are traversed by partial gas volumes. De Giorgi also shows successive precipitator fields in series. A similar disclosure is seen in U.S. Pat. No. 2,626,676 of Phyl et al.

For a given temperature, flow rate and dust content of a gas, the efficiency of a precipitator field is directly proportional to the potential in the electrodes. Efficiency is considered as the statistical probability that a given dust particle will have been discharged from the gas before it leaves the field. However, voltage cannot be increased indefinitely because too high a voltage will cause breakdowns in insulation and hence sparkovers which are unacceptable because of damage caused to electrodes. There would also be the danger that greatly increased voltage will cause the output (wattage) of the generating set to be exceeded at a given amperage i.e. at a given ionization current taken by the dust being charged or discharged.

Voltage control is therefore applied by automatic devices, well known in the art, (see, for example, U.S. Pat. No. 3,166,705) which continually sense the current flowing in each field so as to detect the number and intensity of sparkovers in the time unit and which, when excessive storage of these measured values is detected, are self-regulating so as to lower the voltage unit it falls. Once the reduced level has been reached, such a device attempts to build up voltage again; in effect the control devices build up to a maximum voltage in combination with a predetermined low number and intensity of sparkovers in the time unit, resulting in the most favorable performance.

Also, gas flow is seldom exactly uniform. It is normally stratified into layers of different temperature or dust load. Therefore it is efficient to have each field as small as possible and with individual control, so as to respond to such inequalities.

Another aspect of efficiency concerns rapping. Rapping is most efficient if it is done when there is a certain thickness of layer of dust accumulated on the collector electrodes. Also one tries to keep the rate of rapping as low as possible because each rap will necessarily liberate a certain amount of dust back into the gas stream; so it is inefficient to rap more often than is needed. De Giorgi suggests therefore to set rapping apparatus to operate at rates which are different as between different serial stages and which agree with expected rate of accumulation of dust in each respective stage.

However, De Giorgi disclosed only separate rapping devices for the stages which are arranged in series, while the stages which are arranged above one another are contrary to the object of the present invention, rapped jointly.

SUMMARY OF THE INVENTION

In the invention, a plurality of stages are arranged in a plurality of tiers. Each stage is provided with its own rapper and its own electrostatic control. Each is independent of any other whether in the same tier or in the same array (an array consists of stages arranged vertically above one another). In contrast to De Giorgi, one has a compact plurality of separate electrostatic precipitator fields of which each is self-regulated so as to work at its greatest efficiency bearing in mind the position of that field in the gas flow and in the totality of all the precipitator fields.

For example, the removal of a certain amount of dust by the first stage encountered by the gas will imply different working conditions for the second stage. In practice the removal of the dust will mean higher potentials can be used at the second stage so that the inherent efficiency of the second stage is higher than it would have been if its voltage was merely the same as that of the first stage. It can be seen that the totality of the efficiency of the device then becomes much greater than if it were merely a lot of stages but all set at the same voltage.

Because of the increased efficiency of the stages taken together one could also imagine a horizontal compaction of the total precipitator volume which is required for treating a given flow of gas.

There is also the safety factor inherent in separate supply. Even if it were conceded (which is not disclosed or suggested) that De Giorgi's successive stages in series were separately supplied with electricity so that one remained in operation if the other failed, this would be in no way equivalent to the result obtained from the present invention, which increases the efficiency of each stage which remains in working condition as compared to what the efficiency would have been if there had merely been a failure of one stage which was under independent power supply; that is to say, if we assume a first stage to be traversed by the gas to have failed, the power supply in what previously was the second stage is self-regulating so that this stage is now automatically adjusted to a condition which is that implied by being now the first stage, and so on down through the series of stages traversed by the gas.

In accordance with the invention electrical precipitator devices present in one or more chambers are arranged in at least four stages at least two of which lie one above the other and each of which is separately charged and constitutes a separate electrical precipitator field unit, the electrodes of each of such stages being arranged one above the other and having separate rapper mechanisms. The collector electrodes of each precipitator device in the upper tier are constructed in a form which is in itself known, and those in the vertically lower electrostatic precipitator device are formed as closed hollow electrodes and at their top ends are connected in a dust-tight manner with dust catcher pockets for the electrical precipitator device lying respectively above them, which pockets, together with the hollow electrodes of the lower precipitator field serve as conveyor channels for the dust precipitated in the electrical precipitator field unit of a stage in the upper tier. Each stage is provided with its own independent and separately controlled power supply means which includes a self-regulating device for effecting the control. This invention is advantageously applicable to large-sized electrostatic precipitator plants, for example, for power stations. As outlined above, this reduction in space requirement is achieved by attaining a more efficient dust-separation per unit volume of the precipitator plant, and this increased efficiency is made possible because:

(i) Each filter tier treats only a partial volume of gas with two or more separate controllable precipitator field units in series one behind another, each of relatively small electrostatic field size which therefore can be controlled up to the guaranteed high value of dust collection efficiency with the necessary high voltage without the ionizing current being too much increased, that a breakdown of the standing arc can occur.

(ii) Each stage is independently of the other stages, provided with separate controllable power supply means, each stage including self-regulating power supply means capable of adjusting the power supply so as to adjust each respective high voltage therein, to a desired value dependent upon the conditions (for example, dust loads, flow rate and temperature of the gas) which obtain in each stage, it being possible to obtain the required electrical characteristics using only a small electrostatic power in each stage and (iii) Each stage is provided with a separate rapping device for both the active and the collecting electrodes, and should such a stage become inactive due to failure, then the rapping device associated with that stage is also automatically shut off, so preventing reentrainment in the gas, of dust which may be clinging to the electrodes in the inactive stage.

By reducing the size of an electrical field unit, the ionizing electrical current for a given dust-collecting surface area is reduced. Thus (a), for a given power supply, a higher electrical separation voltage (and hence a more efficient dust collection) can be achieved without the ionizing electrical current rising beyond a predetermined maximum level, or alternatively (b), a given electrical separation voltage is obtained with a lower power supply. By connecting each separate field unit to a respective separate high voltage rectifier, the electrical separation voltage in each unit can be independently self-regulated so that it is sufficiently high to obtain the required high efficiency of dust separation and yet not, because of the small electrostatic power in each unit, cause an ionizing current sufficiently high to produce short-circuiting (see (a) above).

In a precipitator assembly embodying the invention which makes use of the abovementioned principle the ionizing current of each precipitator field can be kept within certain limits and the whole of the electrostatic precipitator volume can be divided in a most economical manner into a plurality of separate electrostatic precipitator fields. This is all the more desirable because in some countries, at least, antipollution regulations demand that the permissible emission of dust should not be exceeded even in the event of breakdown of an electrostatic precipitator. It is, e.g. demanded that the dust content in treated air should not exceed 150 mg/Nm$^3$ (standard cubic meters) even if one train of electrostatic filters or one electrostatic filter field is out of action.

It can be seen however that embodiments of the present invention diminish the space requirement of large electrostatic precipitator installations by the use of multistage electrostatic precipitators with horizontal throughflow, having separate stages each constituting separate precipitator fields above one another and behind one another in the direction of flow but with vertical compactness in that the lower precipitator devices act, in effect, as dust pockets or bunkers for the next uppermost ones, this permitting at the same time the order of magnitude and height of each electrical field to be kept within the most favorable limits within which the disadvantages described can be avoided, and offering also the possibility of designing in such a way, with a plurality of stages in series that in the event of one filter train or one filter field going out of action the permissible emission of dust is not exceeded.

In a further development of the invention in e.g., a two-tier multistage filter and flue gases may be led through the electrical precipitator fields in the lower train while in the upper train of the electrostatic precipitator installation the flue gases are led in the opposite direction. In this way the dust loading on the bunkers gets more uniformly distributed, because with two electrostatic precipitator fields arranged in series about 90% of the dust precipitates in the first field through which the gas passes and about 10% in the second field. The bunker capacity of the second field in line is therefore in the normal construction not put to optimum use, but by taking the flue gases the opposite way through the electrical fields of the respective trains more uniform utilization of the dust handling devices at the base of the installation can be achieved. The gases led through the respective trains may, in a large installation, derive from respective separate air preheaters and be moved by separate fans producing respectively forced draught and induced draught.

DESCRIPTION OF PREFERRED EMBODIMENTS

Figure 1:
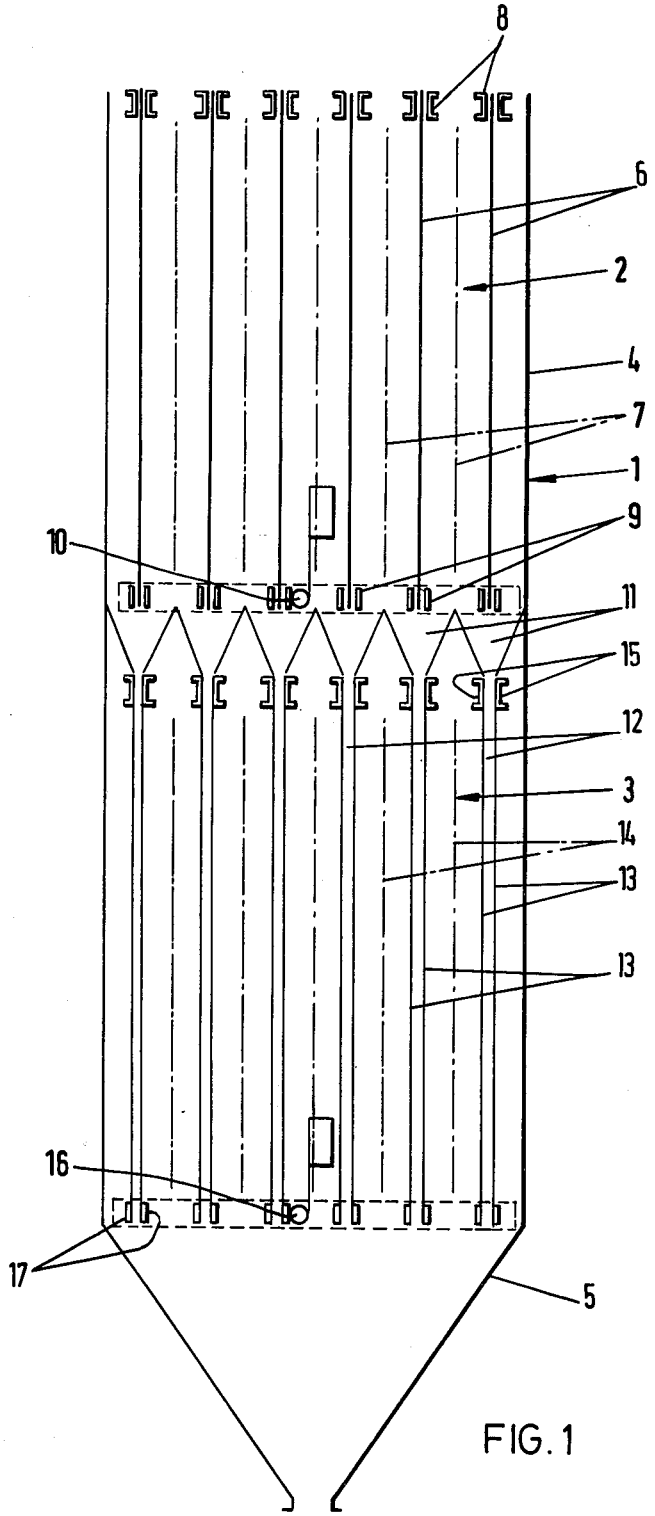
FIG. 1 is a vertical section a part of a multistage electrostatic precipitator with horizontal throughflow and embodying the invention.

In FIG. 1 said part of a multi-staged electrostatic precipitator assembly 1 has an upper stage 2 in an upper tier and a lower stage 3 in a lower tier, which stages 2,3 are separated from each other from the point of view of gas flow but contained within a housing 4 of which the base 5 is formed as a dust exit bunker. There is a plurality of tiers greater than two, and a plurality of stages greater than two in each tier forming a train of stages.

Figure 2:
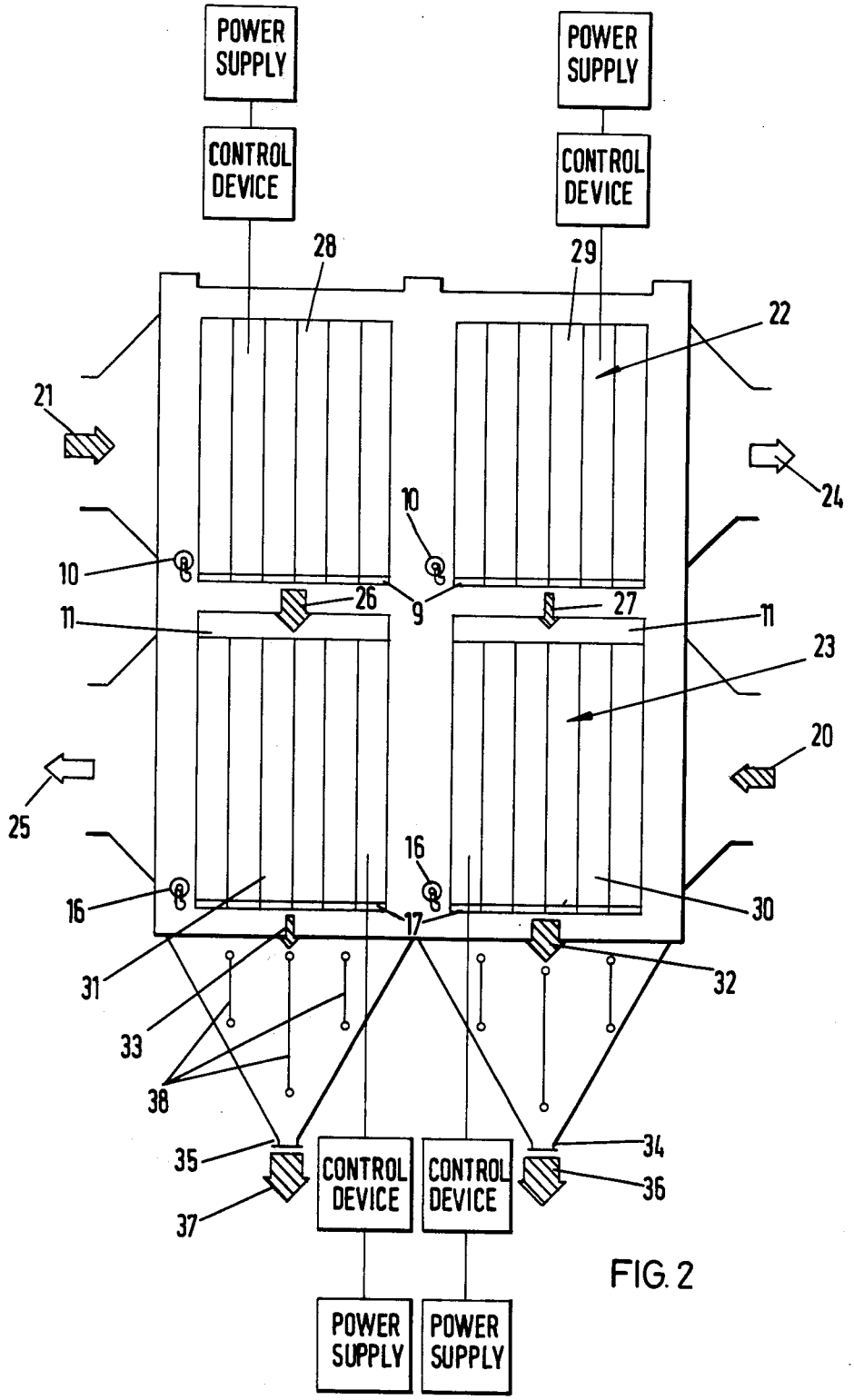
FIG. 2 is a side elevation of a part of a multistage electrostatic precipitator embodying the invention and in which the gas flow through a part of the fields in the upper train is in the direction opposite to that of the gas in the lower train precipitator fields.

The upper stage 2 has a precipitator field made up of collector electrodes 6 and active electrodes 7. The construction and arrangement of these is conventional, the collector electrodes being supported by suspension beams 8 and having at their base rods 9 acted on by rapper apparatus 10 (FIG. 2).

Dust collected by electrodes 6 and falling from them is discharged to the exit bunker at the base 5 of the housing via respective collection pockets 11 which are at the upper end of the lower stage 3 of the assembly.

These collection pockets open downwardly to respective passages 12 which in turn open to the base 5 of the housing. Walls of the passages 12 are defined by collector electrodes 13 of the lower stage 3, which also has active electrodes 14. Thus collector electrodes 13 are, in effect, hollow and provide passages 12, within them for dust from the upper stage. Dust collected by electrodes 13 themselves in the lower stage falls directly from them into the base 5 of the housing, the exit bunker of which thus receives dust both from lower and upper stages. The dimensioning of the conveying cross-section of these hollow electrodes and the profiling of these electrodes can be determined according to the residual charge on the dust. Furthermore the possibility is provided of designing the inner surfaces of the hollow electrodes insulated or dust-repellent by appropriate treatment or by surface coating with an insulating or dust-repellent material e.g. Teflon (Registered Trade Mark).

Lower collector electrodes 13 are borne by suspension beams 15 and at their lower ends are acted on by rapper apparatus 16 (see particularly FIG. 2) through rapper rods 17. The collector electrodes 13 are of sheet form being e.g. a sheet metal pressing, and their ends are closed to prevent horizontal flow of gas through the passages 12 between them. Also baffles 38 in the base 5 of the casing prevent excessive horizontal gas flow therein. Rapper apparatus may alternatively or additionally act on the suspension beams. To enable continued working in the event of loss or failure of one train of stages, or of one stage within one train, separate rapper apparatus and power supply means are provided, each power supply means being self-regulating so as to automatically control the voltage generated in each stage in dependence of the conditions which are obtained therein.

The rapper apparatus 16 for the rods 17 of the lower stage may act also on the pockets 11, the shocks being transmitted through the collector electrodes 13. The pockets 11 may also be constructed to be slightly movable while being in effectively dust-tight engagement with the lower collecting electrodes 13 and then a separate rapper apparatus or the rapper apparatus 10 of the rods 9 of the upper stage may act also on the pockets 11. If necessary the upper and lower precipitator stages 2 and 3 can have partial quantities of the flue gas flowing through them in opposite directions in order thereby to achieve more uniform dust loading along the dust collection pockets and exit bunker.

FIG. 2 shows diagrammatically the upper and lower tiers of a multistage electrostatic precipitator being acted upon in contraflow.

Dark horizontal arrows 20,21 show inflow of dust-laden gas to the separate upper train 22 and lower train 23 of stages from respectively different air preheaters, impelled by respective fans producing forced draught, while hollow horizontal arrows 24,25 represent outflow of cleaned gas to respective fans producing induced draught. Vertical arrows 26,27 show how dust falls from the stages 28,29 of the upper train 22 which are traversed in series by the gas, and how the majority of the dust, up to 90%, is removed in the first stage (28) traversed.

In the stages 30,31 of the lower train 23, traversed in the opposite direction, more dust, represented by arrow 32, is removed in the first stage 30 than in the second 31. The latter dust downflow is represented by arrow 33. It can be seen that in broad terms the sum total of dust collected in each vertical array can be more or less equal so that the total amounts of dust to be handled by respective exit bunkers 34,35 and represented by arrows 36,37 can be more or less balanced.

The stages constituting electrostatic fields are also arranged in vertical arrays, one such array being made up of stages 30,29 and another of stages 31,28. The interrelation of parts within these vertical arrays is as described with reference to FIG. 1.

The advantages achieved by these embodiments consists particularly in the fact that the space requirement of large electrostatic precipitator installations is reduced to half the width in plan of that which would have been required for a single tier installation and in doing so sub-division a number of times into mechanically and electrically separate regulated precipitator fields becomes possible, whereby the separation efficiency within each separate precipitator field can be regulated to a guaranteed value, so that in the event of one filter train or one filter field going out of action the permissible maximum emission of dust emission from the precipitator assembly as a whole will not be exceeded.

Moreover the space-saving manner and construction of the multistage electrostatic precipitator described above allows electrostatic fields of sufficient efficiency to be provided within an electrostatic precipitator installation of comparatively compact dimensions.

We claim:

1. In an electrostatic precipitator assembly having a housing, at least two first precipitator stages contained within said housing and arranged vertically one above another to form a first vertically arranged array of upper and lower precipitator stages, said housing having a first gas inlet duct means at one end and a first gas outlet duct means at another end, each said stage including active electrodes and collector electrodes, dust collection pockets mounted immediately below the collector electrodes in said upper stage of said vertically arranged array, a dust exit bunker mounted below the lower stage in said array, the dust exit bunker being below the collector electrodes of said lowermost stage to receive dust precipitated from it, the collector electrodes of the lower stage having two spaced apart elements each having two faces, one face of each element facing an active electrode, the other face of the two elements being in mutual opposition, dust passages being defined by the two mutually opposed faces of said two elements of the collector electrodes, the dust passages extending downwardly from respective dust collection pockets to the dust exit bunker whereby the exit bunker receives in common dust from the upper and lower stages, the improvement comprising at least two additional precipitator stages contained within said housing within which said two first precipitator stages are contained, said two additional precipitator stages being arranged vertically one above another to form a second vertically arranged array of upper and lower precipitator stages, said housing having a second gas inlet duct means and a second gas outlet duct means, said first and second inlet duct means and said first and second outlet duct means are disposed for one horizontal gas flow through each of said upper stages and for another horizontal gas flow through each of said lower stages, separate rapper apparatus for separately rapping the collector electrodes in each stage, and separate power supply means for each said stage.

2. The electrostatic precipitator assembly defined in claim 1 having a support frame for the electrodes of the lower stages at the top end thereof, and said support frame supporting said dust-collection pockets in dust-tight relation with collector electrodes of the lower stages, said dust collection pockets having bottom open ends, which are in communication with the dust passages defined between the elements of said collector electrodes.

3. The electrostatic precipitator assembly defined in claim 1 wherein the respective said first gas inlet duct means and said second gas inlet duct means are at opposed sides of said assembly, thereby providing gas flow in opposite horizontal directions through vertically adjacent stages in the respective arrays.

* * * * *